US009863702B2

(12) United States Patent
Cesar de Souza Pinto et al.

(10) Patent No.: US 9,863,702 B2
(45) Date of Patent: Jan. 9, 2018

(54) PROCESS FOR ORE MOISTURE REDUCTION IN CONVEYOR BELTS AND TRANSFER CHUTES

(71) Applicant: VALE S.A., Rio de Janeiro (BR)

(72) Inventors: Thiago Cesar de Souza Pinto, Ribeirão Preto (BR); Márcio de Alcântara Costa, Rio de Janeiro (BR); Laurindo de Salles Leal Filho, Belo Horizonte (BR); Danilo da Fonseca Silva e Silva, Mangaratiba (BR)

(73) Assignee: VALE S.A., Rio de Janeiro (BR)

( * ) Notice: Subject to any disclaimer, the term of this patent is extended or adjusted under 35 U.S.C. 154(b) by 37 days.

(21) Appl. No.: 14/988,525

(22) Filed: Jan. 5, 2016

(65) Prior Publication Data

US 2017/0115059 A1 Apr. 27, 2017

(30) Foreign Application Priority Data

Oct. 27, 2015 (BR) ..... 102015027270-7

(51) Int. Cl.

| | |
|---|---|
| ***F26B 17/04*** | (2006.01) |
| ***F26B 3/04*** | (2006.01) |
| ***F26B 17/14*** | (2006.01) |
| ***F26B 21/00*** | (2006.01) |
| ***F26B 23/06*** | (2006.01) |
| ***F26B 3/06*** | (2006.01) |
| ***F26B 3/16*** | (2006.01) |
| ***F26B 15/18*** | (2006.01) |
| ***F26B 17/00*** | (2006.01) |
| ***F26B 17/12*** | (2006.01) |
| ***F26B 21/08*** | (2006.01) |
| ***F26B 23/00*** | (2006.01) |

(52) U.S. Cl.

CPC ..... *F26B 17/04* (2013.01); *F26B 3/04* (2013.01); *F26B 3/06* (2013.01); *F26B 3/16* (2013.01); *F26B 15/18* (2013.01); *F26B 17/00* (2013.01); *F26B 17/12* (2013.01); *F26B 17/1408* (2013.01); *F26B 21/001* (2013.01); *F26B 21/002* (2013.01); *F26B 21/086* (2013.01); *F26B 23/00* (2013.01); *F26B 23/06* (2013.01)

(58) Field of Classification Search

CPC ..... F26B 3/04; F26B 17/04; F26B 17/408; F26B 21/001; F26B 21/002; F26B 23/06

USPC ..... 34/468, 201

See application file for complete search history.

(56) References Cited

U.S. PATENT DOCUMENTS 1,757,716 A * 5/1930 Johnson ..... F26B 9/106 126/110 R
1,791,561 A * 2/1931 Heyn ..... F26B 21/001 110/260

(Continued)

FOREIGN PATENT DOCUMENTS

DE 3518053 C1 * 4/1986 ..... C21B 13/00
JP 58104106 A * 6/1983 ..... C21B 13/0066
WO WO 2009119291 A1 * 10/2009 ..... C22B 1/22

*Primary Examiner* — Stephen M Gravini
(74) *Attorney, Agent, or Firm* — Arent Fox LLP

(57) ABSTRACT

A process for ore moisture removal by exposure of the ore to a hot and dry air stream is described. Also described is a conveyor belt and a transfer chute adapted for the use of the above process. Among other aspects, the process has the function of reducing moisture in ores prior to the shipping stage of this material.

17 Claims, 4 Drawing Sheets

(56) References Cited

U.S. PATENT DOCUMENTS 1,940,246 A * 12/1933 Clark ..... C21B 13/02 266/122
2,395,933 A 3/1946 McBeth
2,415,738 A 2/1947 Freund
2,446,147 A * 7/1948 Walund ..... F26B 21/001 34/72
2,671,968 A * 3/1954 Criner ..... F26B 17/04 34/216
2,682,116 A * 6/1954 Dungler ..... D21F 5/00 34/448
2,887,390 A * 5/1959 Coulter ..... A23B 5/035 159/4.03
3,130,961 A * 4/1964 Verner ..... F26B 17/04 110/203
3,400,465 A * 9/1968 Von Stroh ..... F26B 17/04 34/443
3,894,344 A * 7/1975 Malcolm ..... F26B 3/00 34/385
4,316,718 A * 2/1982 Drugge ..... F26B 17/04 198/811
5,531,034 A * 7/1996 Mentz ..... F26B 23/06 219/388
6,226,891 B1 * 5/2001 Chapman ..... F26B 17/04 34/210
6,421,931 B1 * 7/2002 Chapman ..... F26B 17/04 34/210
8,006,407 B2 * 8/2011 Anderson ..... F26B 21/001 110/224
8,161,661 B2 * 4/2012 Bartol ..... F26B 17/1483 110/235
8,959,793 B2 * 2/2015 Zea ..... F26B 3/04 165/104.21
9,169,532 B2 * 10/2015 Botelho ..... C22B 1/2406
9,207,185 B2 * 12/2015 Vieira ..... G01N 21/84
9,580,769 B2 * 2/2017 Reis ..... C22B 1/2406
9,586,212 B2 * 3/2017 Silva ..... B03D 1/018
2014/0290251 A1 * 10/2014 Sugasawa ..... F23K 1/00 60/670

* cited by examiner

PROCESS FOR ORE MOISTURE REDUCTION IN CONVEYOR BELTS AND TRANSFER CHUTES

CLAIM OF PRIORITY

This application is based upon and claims the benefit of priority to Brazilian Patent Application No. 10 2015 027270 7, filed Oct. 27, 2015. The disclosure of the prior application of which is hereby incorporated in its entirety by reference.

FIELD OF THE INVENTION

The present invention is a process and equipment for ore moisture reduction prior to shipping operations of this material.

BACKGROUND OF THE INVENTION

Conveyor belts and transfer chutes are equipment used for the transport of various materials, in casu, for the transport of ores.

The conveyor belt consists of a device basically formed of an endless belt which is extended between two drive drums (driving and return) and an internal structure constructed by laminated profiles and juxtaposed rollers, over which the belt slides enabling the movement of the ore positioned on the belt.

The transfer chute consists of a device commonly applied for the transfer of material between conveyor belts that operate in different directions. This basically consists of a funnel, formed by associated steel plates and wear material, assembled to intermediate the transfer of material.

Conveyor belts and transfer chutes are used specifically in this case to carry the ore that arrives at the boarding terminal by rail. After homogenization on stacks and ore recovery, this goes through conveyor belts and transfer chutes to the ships for carrying out the transport to the final destination. However, not rarely, the ore transported by such equipment has a considerable moisture content, which is a detrimental characteristic to maritime transport.

The moisture content of the ore carries serious drawbacks to its shipping. The first one is related to the cost of freight as each unit of water transported represents additional costs, such as penalties to the supplier as the sold ore is assessed on a dry basis. In addition, it decreases ore transport capacity, causing significant losses.

Nevertheless, it is known that the maritime transport of excessively wet bulk solid cargo may imply a risk of tipping and cargo ship sinking, due to a phenomenon known as "granule load liquefaction," which occurs when moist ore is submitted to boat balance, engine vibration of the vessel and the successive impacts from the sea to the ship hull. When the ore is with a moisture percentage above a value corresponding to a Flow Moisture Point (FMP) and is subjected to such vibration conditions, it can liquefy. When the material liquefies, this viscous mixture can move improperly in the holds of the vessel to the bottom and/or walls, unbalancing and eventually leading the ship to sink due to inertial forces acting on the ore cargo/ship.

So to prevent that ores with high moisture content are transported, government technical standards created the TML (Transportable Moisture Limit), which is the maximum amount of moisture that the ore must contain in order to be fit for transport vessels. In practice, the value adopted for the TML is equivalent to 90% of the FMP.

Thus, the use of equipment and processes to ensure compliance with the TML requirements for moisture of the ore prior to shipment of the material is critical.

In the state of the art, can be used various types of drying equipment such as, rotary kilns. These devices usually have high installation costs, operation and maintenance mainly due to high energy consumption. In addition, it is necessary that this drying equipment is installed in series with transport equipment (conveyor belts, chutes, among others). So changes were needed in the transportation lines for the installation of this kind of drying equipment, resulting in layout changes—process flowchart—due to the need for more room. Nevertheless, it would take longer breaks in the transportation lines for installation, which significantly raise costs and undermine substantially the flow of production, also implying in need of large areas for storage yards.

Thus, the use of state of the art drying equipment to reduce ores moisture, implies high costs on the acquisition, installation, operation and maintenance of equipment.

The state of the art also includes devices for drying, or even dehydration of foods and other materials. One of this equipment is revealed in the document U.S. Pat. No. 2,395,933.

The equipment disclosed in U.S. Pat. No. 2,395,933 is set to generate a hot air flow directed into the material being transported by a conveyor belt. Such equipment comprises a conveyor belt, a fan, a heater and specific meters.

The conveyor belt is set to perform transportation of the material along the machine, and the environment is isolated to allow the air blown by the fan remains inside the machine.

The fan is set to blow air into the equipment, and it is installed in series with the heater. The fan blades are set to direct air blown by the fan into the material being transported. These can be oriented in the direction that is most convenient to the process, such that all material present on the belt is dehydrated. Also temperature measurements are performed, air moisture and material as well as other variables involved.

Although the equipment disclosed in document U.S. Pat. No. 2,395,933 perform a reduction of moisture products transported on a belt, it is not suitable for moisture reduction of ores. The above document equipment does not previously perform moisture removal from the air used by the process, so that it shows a lower efficiency during the drying of the material.

Other equipment comprised in the state of the art is disclosed in document U.S. Pat. No. 2,415,738. This document presents equipment for partial dehydration of cellulose containing products, food products and other industrial materials. Such equipment consists of a conveyor belt set in isolated environment within injection of hot gases.

The equipment comprises a conveyor belt, exhaust ducts, gas compartment, pumps, and monitoring system. The environment in which the conveyor belt is located is isolated in such a way that the gases remain inside, and the pumps are set to inject hot gas in that isolated environment.

The intake duct is responsible for the admittance of gases, while the exhaust duct is set to remove the excess gases of the internal environment. The exhaust duct also allows the reuse of gases removed, returning them to the drying compartment.

Measurements of the variables involved in the process such as temperature and flow rate of the gases are performed. The variable monitoring system allows changing the machine settings, ensuring its better functioning.

Similarly to patent document U.S. Pat. No. 2,395,933, the document U.S. Pat. No. 2,415,738 discloses a device that carries out a reduction in moisture contained in industrial materials carried in a belt, however, this equipment is not suitable for moisture reduction of ores. The above document equipment does not previously perform moisture removal from the air used by the process, so that it shows lower efficiency and high energy consumption during the drying of the material.

Owing to the equipment described in these documents, there is not, in the state of the art, a process or equipment applied for ores moisture reduction, to percentages below the TML, which has low installation, operation and maintenance cost.

SUMMARY OF THE INVENTION

The present invention aims at a process for ores moisture reduction in conveyor belts and transfer chutes, at low cost of installation and operation.

The present invention also aims at a device for ores moisture reduction in conveyor belts and transfer chutes, at low cost of installation and operation.

BRIEF DESCRIPTION OF THE DRAWINGS

The present invention is described in detail based on the respective figures.

DETAILED DESCRIPTION OF THE INVENTION

Figure 7:
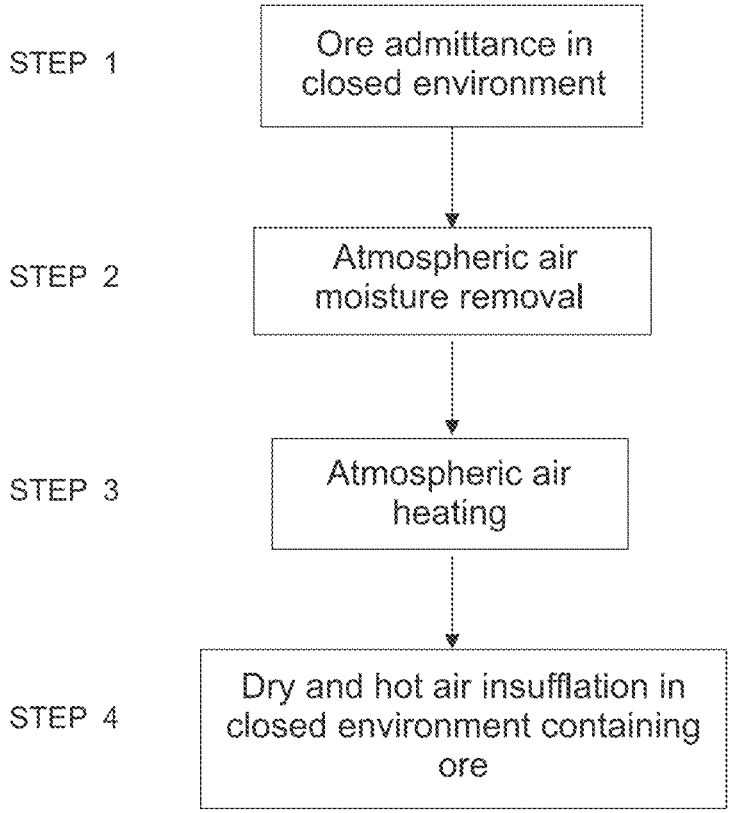
FIG. 7—shows a flow chart of the implementation process of the present invention in its preferred setting of use.

The present invention, as disclosed in FIG. 7, consists of a process for reducing the ores moisture 2, comprising the following steps:

step 1—ore 2 insertion in a closed environment;

step 2—moisture removal from the atmospheric air;

step 3—heating of the atmospheric air coming from the step 2;

step 4—insufflation of dry and heated air from step 3 in a closed environment containing ore 2 of step 1.

Figure 2:
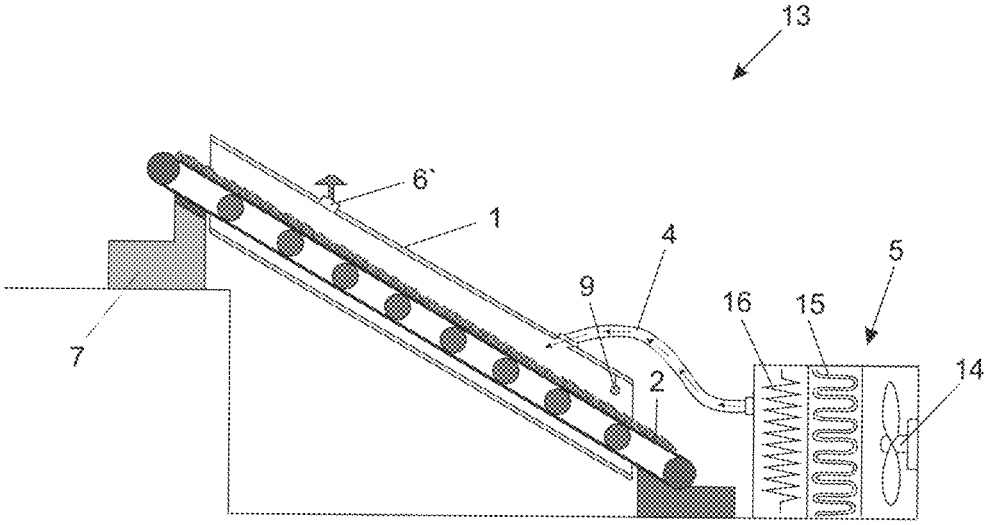
FIG. 2—depicts a front view, in section, of the belt revealed in FIG. 1.
Figure 4:
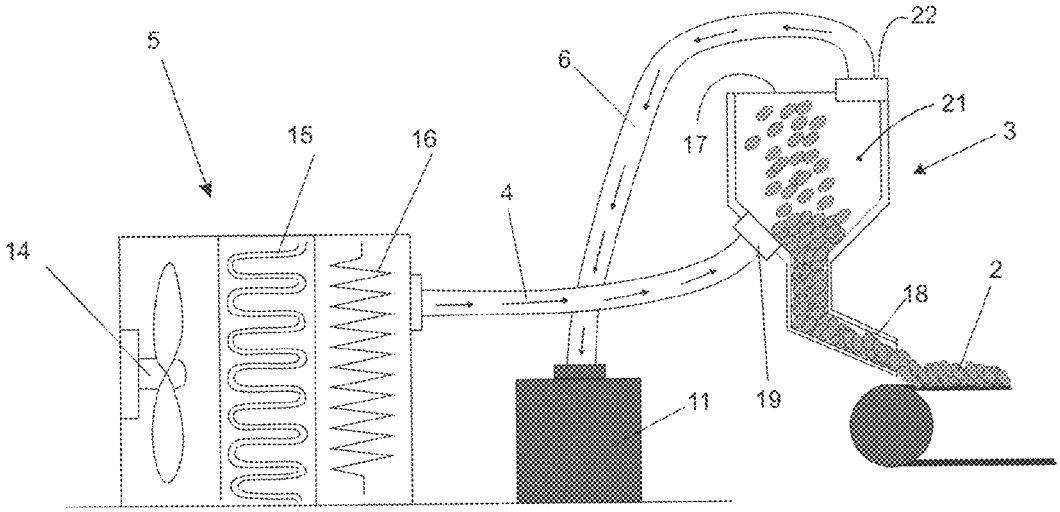
FIG. 4—depicts a front view, in section, of the transfer chute in FIG. 3.

The removal of moisture from the atmospheric air depicted in step 2 is preferably carried out by condensation of the water vapor present in the air with the aid of evaporator units comprised of a cooling system (see FIGS. 2 and 4).

It is known that the cooling system comprises an evaporator unit, a condenser unit, a compressor and an expansion valve, operating in a closed thermodynamic cycle. A coolant fluid circulates between the four elements, being injected into the compressor, which performs a work on the fluid and thus increases its temperature. After the compressor, the fluid passes through the condenser, aiming at its condensation, cooling down the fluid. Further, this fluid passes through the expansion valve, where it undergoes an abrupt pressure and temperature reduction. The evaporator is responsible for the evaporation of part of the liquid generated in the expansion of the fluid, ensuring that the mixture gas/liquid is completely evaporated and return in the form of gas to the compressor completing the thermodynamic cycle.

When passing through the expansion valve, the coolant fluid is sprayed, achieving very low temperatures. In the evaporation unit, the fluid goes through a serpentine surrounding a mesh of metal fins, whose function is to increase the heat exchange efficiency. Water vapor in the atmospheric air which goes through the evaporator coil, then condenses when in contact with the fins and the serpentine comprised by the evaporation unit of the cooling system.

For this reason, atmospheric air, coming in contact with the evaporation unit of a cooling system loses moisture and its temperature is decreased. Generally speaking, this is the beginning of atmospheric air drying performed in step 2 of the moisture reduction process of the present invention.

To heat up the dry air from step 2, it passes through a circuit of electrical resistors or a heat exchanger such as a boiler, a gas burner of direct or indirect contact. This heating of the cold and dry air is the third step of the process defined by the present invention.

The fourth step is the exposure of the ore 2 to hot and dry air from step 3. Such exposure makes this hot and dry air injected into the closed environment remove part of the moisture from the ore body 2, using the heat and mass transfer principles.

To avoid thermal power losses in step 4, the environment should preferably be covered by an upstanding material, without holes and equipped with thermal insulation capacity.

The method disclosed above should be carried out on a conveyor belt 13 and/or a transfer chute 3, or environments that allow the continuous flow of ore 2, and hot and dry air.

Figure 1:
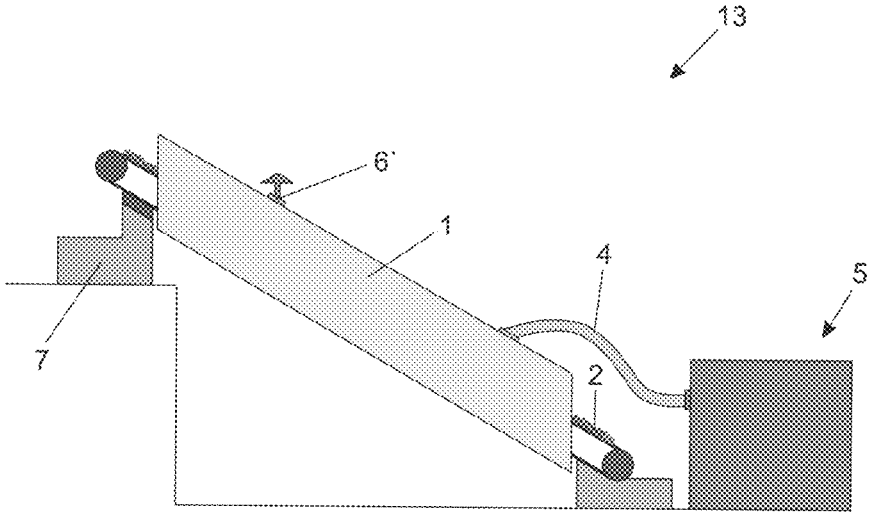
FIG. 1—depicts a front view of a conveyor belt adapted to the process defined by the present invention.

The conveyor belt 13 disclosed in FIGS. 1 and 2 of this document comprises an insulating duct 1 and a hot and dry air provider unit 5, comprising an evaporator unit 15 (set for this water vapor condensation in the environment); a heating unit 16; and a forced ventilation unit 14. Preferably, the hot and dry air provider unit 5 communicates with the internal portion of the insulating duct 1, through feeding duct 4

For purposes of defining the scope of the present invention protection, it is understood as evaporator unit 15, any device capable of removing moisture from the atmospheric air by condensation of water vapor. This definition includes air conditioners, the Fan Coil type devices and other industrial refrigeration equipment, which uses cooling gas, or even membranes using fluids, usually chilled water, obtained with the use of chillers in order to achieve the wet bulb temperature of the atmospheric air.

To give greater precision and efficiency to the ore moisture removal process, the conveyor belt 13, in its preferred setting, comprises at least one measuring device 9 and an automated controller 7. Measuring equipment 9 consists of electronic accessories, such as: thermometers/dry bulb thermocouples and wet bulb, pressure gauge, anemometer, air moisture meter, ore moisture meter and infrared contact thermometer for measurement the temperature of ore and surface of the conveyor belt.

The above mentioned measuring devices 9 are connected to the automated controller 7 which consists of a control panel installed near the conveyor belt 13. The automated controller 7 processes the information from the measurements taken by the measuring equipment 9 and performs automatic changes to the functioning of all the elements of the conveyor belt 13 system, having as main change focus the hot and dry air unit provider 5. Historical data of information obtained in the system is also recorded and archived.

Such alterations are carried out for controlling process key parameters, so that the conveyor belt 13 operates at optimal process conditions, being constantly monitored so that the best results of ore moisture reduction are achieved.

Even more efficient than the process of ore moisture removal on conveyor belt 13 is the moisture removal in transfer chute 3.

In general, for purposes of defining the scope of the present invention, a transfer chute can be defined as a sealed receptacle set to gravitational transport of minerals, comprising an ore inlet 17 in its upper portion, one ore outlet 18 in its lower portion and a central chamber 21.

Figure 3:
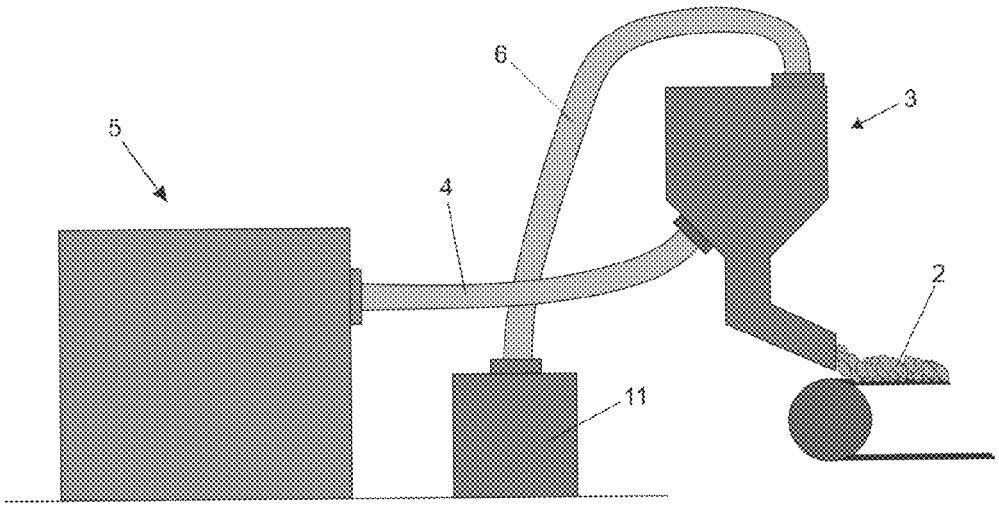
FIG. 3—depicts a front view of a transfer chute adapted to the process of the present invention.

As viewed in FIGS. 3 and 4 of this document, the principle of operation of the transfer chute 3 of the present invention is almost the same as the conveyor belt 13. However, the moisture reduction process in transfer chute 3 is usually more efficient than in conveyor belt 13 because there is greater contact surface between the transported ore and the air from the hot and dry air provider unit 5, since there is fluidization of the belt ore bed, significantly increasing the exposed area. This type of equipment may be associated with a flash dryer process as the time of exposure of mineral particles to hot and dry air is a few seconds.

The hot and dry air is blown, in counter flow to the ore, inside the transfer chute 3 through an air inlet 19, through a hot and dry air provider unit 5 associated with a feed duct 4. The hot and dry air provider unit 5 also includes an evaporator unit 15, a heating unit 16, a forced ventilation unit 14 as well as chiller type water cooling units.

When hot and dry air comes into contact with the ore 2 in the transfer chute 3, a cloud of suspended particles is generated, named "particulate material". If there were no proper treatment, this dispersion of particulate material in the atmosphere could incur undesirable loss of material and also generate air pollution.

To solve this problem, the transfer chute 3, in its preferred setting comprises an exhaust duct 6 communicating an air outlet 22 to a compartment 11. The exhaust duct 6 is set to perform the removal of air containing particulate matter and transfer it to a compartment 11 which performs a cycloning process. Cycloning allows the collection of particulate matter, making air cleaning before returning it to the atmosphere. The collected particulate matter can be incorporated to the dry ore 2 that leaves the transfer chute 3 or to the ore already stockpiled in storage yards. An amount of circulating load of particulate matter can be created to prevent the accumulation and subsequent handling of this material.

The exhaust system of conveyor belts 13 consists of only one exhaust opening 6' set to allow moist and saturated air is naturally removed from the insulation duct 1, since there is no significant emission of particulate matter on the belts. Note that, on the conveyor belts 13 the air flow can operate in counter flow and/or co-current with the ore on the conveyor belt. For the transfer chute, flow only occurs in counter flow.

Recent experiments have shown that the present invention is able to reduce ore moisture in 0.5-1.8 percentage points on conveyor belts 13, and 0.5-2.0 percentage points in transfer chutes 3, depending on the condition of temperature and air flow used, for the specific case of iron ore with an approximate initial moisture content of 10-12%. The experimental apparatus showed an installed power of 180 kw.h, providing the system with the approximate amount of energy of 650,000 kJ/h.

These values obtained for moisture reduction in iron ore, are very significant because when it is only used hot air, or only dry and cold air for moisture removal, a much greater amount of energy is spent to achieve the same moisture percentage. In other words, one can say that the sum of the unit evaporator 15 to the heater unit 16 comprised by the hot and dry air provider unit 5 show unexpected result, as the effect combination of both is higher than the sum of the parts when taken alone.

That is, the use of the dehumidifying mechanism and the air heating mechanism, when used in isolated form, show lower efficiency in iron ore moisture reduction, as the combined form uses heat and mass transfer principles. Thus it was possible to observe experimentally larger percentage gains in the ore body water removal using hot and dry air to combined mechanisms.

Figure 5:
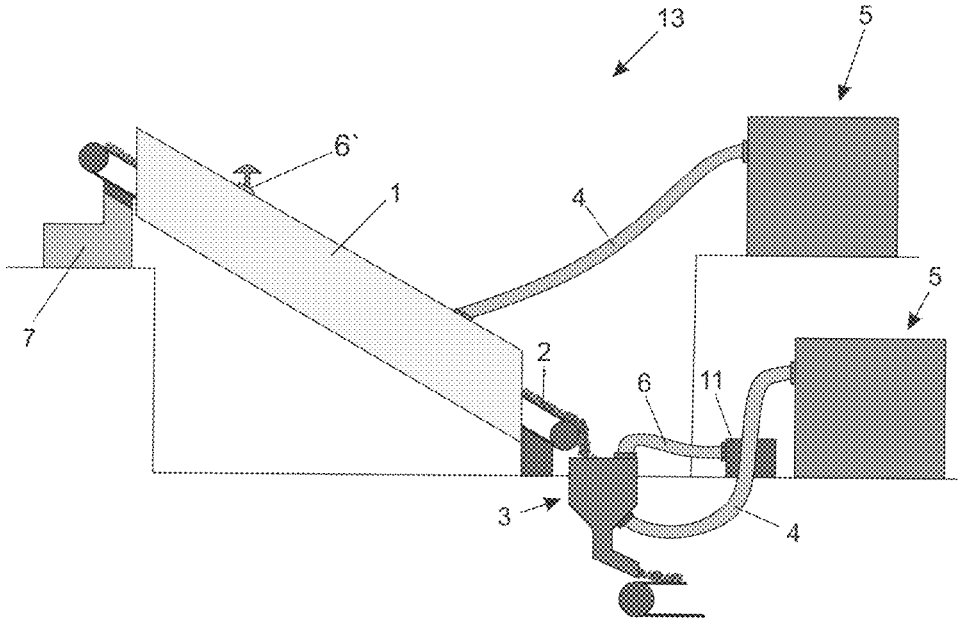
FIG. 5—depicts a front view of the combination of the transfer chute and conveyor belt modified by the process of the present invention.
Figure 6:
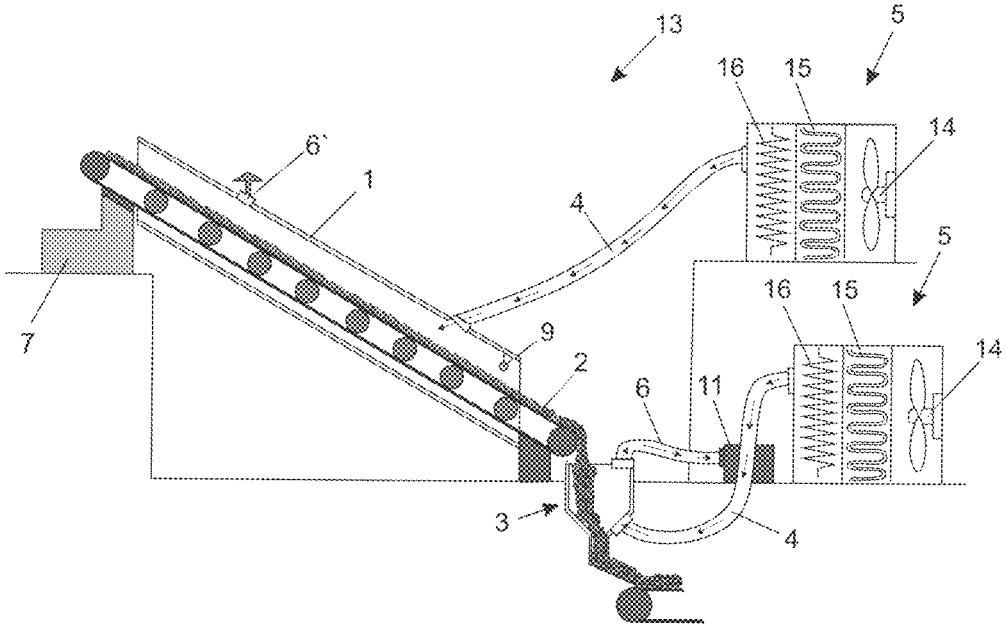
FIG. 6—depicts a front view, in section, of the setting disclosed in FIG. 5.

The combination of transfer chute 3 and conveyor belt 13 evidently provides more significant results than the use of chute 3 or belt 13 apart. For this reason, the preferred setting of the invention comprises at least one transfer chute 3 associated to the conveyor belt 13, as presented by FIGS. 5 and 6.

Finally, it is concluded that the invention achieves all the objectives it intends to achieve, disclosing a process and equipment for ore moisture reduction on conveyor belts and transfer chutes, at low cost of installation and operation.

Having described some examples of preferred completion of the invention, it is noteworthy that the scope of protection conferred by this document encompasses all other alternative forms appropriate to the implementation of the invention, which is defined and limited only by the claimed table content attached.

The invention claimed is:

1. A process to reduce ore moisture, comprising:
inserting ore in a closed and isolated environment;
removing atmospheric air moisture;
heating the atmospheric air; and
insufflating dry and hot air resulting from the removing of atmospheric air moisture and the heating of the atmospheric air into the closed and isolated environment containing the ore.

2. The process for ore moisture reduction of claim 1, wherein the moisture is removed from the atmospheric air by using an evaporator unit comprised of a cooling system.

3. The process for ore moisture reduction of claim 1, wherein the moisture is removed from the atmospheric air by using a Fan Coil type device.

4. The process for ore moisture reduction of claim 1, wherein the heating is carried out by using an electric resistance for heating purposes.

5. The process for ore moisture reduction of claim 1, wherein the heating is carried out by using a heat exchanger comprised of a boiler.

6. The process for ore moisture reduction of claim 1, wherein the heating is carried out by using a gas burner of direct and/or indirect contact.

7. The process for ore moisture reduction of claim 1, wherein the closed and isolated environment includes an insulation duct and a conveyor belt.

8. The process for ore moisture reduction of claim 1, wherein the closed and isolated environment includes an external structure of a transfer chute.

9. The process for ore moisture reduction of claim 1, wherein the closed and isolated environment includes an insulation duct and a conveyor belt connected to an external structure of a transfer chute.

10. A transfer chute to transport ore, comprising:

an ore inlet;

an air inlet;

an ore outlet; and a central chamber;

the central chamber placed between the ore inlet and the ore outlet; and the air inlet being set to inject, into the central chamber, hot and dry air that underwent condensation and heating treatment before entering the central chamber of the transfer chute.

11. The transfer chute of claim 10, further comprising an exhaust duct set to remove the air injected into the transfer chute and transfer it to a compartment after contact of the air with ore contained in the transfer chute.

12. The transfer chute of claim 11, wherein the compartment is configured to subject the air to a cycloning process set to remove particulate material from the air being in contact with the ore.

13. An ore conveyor belt to transport ore, comprising:

an insulation duct installed radially around a structure of the ore conveyor belt, the insulation duct set to isolate the conveyor belt from the external environment;

a hot and dry air provider unit; and a feeding duct set to fluidly communicate an environment internal to the insulation duct to the hot and dry air provider unit.

14. The conveyor belt of claim 13, wherein the hot and dry air provider unit comprises at least one heating unit.

15. The conveyor belt of claim 13, wherein the hot and dry air provider unit comprises at least one evaporation unit.

16. The conveyor belt of claim 13, wherein the hot and dry air provider unit comprises at least one forced ventilation unit.

17. The conveyor belt of claim 13, further comprising an exhaust opening set to remove moist air from inside the insulation duct.

* * * * *